US007950366B2

(12) United States Patent
Arai et al.

(10) Patent No.: US 7,950,366 B2
(45) Date of Patent: May 31, 2011

(54) ENGINE CONTROL SYSTEM

(75) Inventors: Tetsuya Arai, Wako (JP); Takanori Sato, Wako (JP); Ryuhei Tamamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/029,225

(22) Filed: Feb. 11, 2008

(65) Prior Publication Data

US 2008/0223336 A1 Sep. 18, 2008

(30) Foreign Application Priority Data

Feb. 12, 2007 (JP) ..... 2007-031401

(51) Int. Cl.
*F02D 31/00* (2006.01)

(52) U.S. Cl. ..... 123/376; 123/319; 123/349; 123/363

(58) Field of Classification Search ..... 123/376, 123/319, 349, 363
See application file for complete search history.

(56) References Cited

U.S. PATENT DOCUMENTS

| | | | | |
|---|---|---|---|---|
| 2,821,091 | A * | 1/1958 | Benner | 74/482 |
| 3,276,439 | A * | 10/1966 | Reichenbach | 123/376 |
| 4,414,945 | A * | 11/1983 | Bonin | 123/339.29 |
| 4,773,371 | A * | 9/1988 | Stenz | 123/376 |
| 4,785,778 | A * | 11/1988 | Gibson et al. | 123/373 |
| 5,146,889 | A * | 9/1992 | Swanson et al. | 123/376 |
| 5,163,401 | A * | 11/1992 | Reese | 123/376 |
| 5,503,125 | A * | 4/1996 | Gund | 123/392 |
| 6,082,323 | A * | 7/2000 | Winberg | 123/198 DB |
| 6,722,638 | B2 * | 4/2004 | Kojima et al. | 261/39.2 |
| 6,729,298 | B1 * | 5/2004 | Sterr | 123/339.13 |
| 6,983,736 | B2 * | 1/2006 | Mitchell et al. | 123/376 |
| 7,097,163 | B2 * | 8/2006 | Moriyama et al. | 261/52 |
| 7,128,309 | B2 * | 10/2006 | Edamatsu et al. | 261/39.1 |
| 7,152,580 | B2 * | 12/2006 | Wetor et al. | 123/376 |
| 7,165,532 | B2 * | 1/2007 | Steffes et al. | 123/376 |
| 7,246,794 | B2 * | 7/2007 | Suzuki et al. | 261/52 |
| 2005/0194700 | A1 * | 9/2005 | Moriyama et al. | 261/39.4 |

FOREIGN PATENT DOCUMENTS

| | | |
|---|---|---|
| CN | 1727661 A | 2/2006 |
| JP | 2006-242143 A | 9/2006 |

* cited by examiner

*Primary Examiner* — Stephen K Cronin
*Assistant Examiner* — David Hamaoui
(74) *Attorney, Agent, or Firm* — Arent Fox LLP

(57) ABSTRACT

An engine control device includes a governor lever, a centrifugal governor, a control lever operated to oscillate between a low-speed position and a high-speed position, and a governor spring expandedly provided between the control lever and the governor lever. An automatic choke device is connected to a choke valve of a carburetor. A play is provided between the governor lever and the governor spring. The play holds the governor spring in a free state during rotation of the control lever from the low-speed position to the high-speed position by a predetermined angle. A subsidiary spring is provided between a fixed structure and the governor lever so as to constantly urge the governor lever in a direction to open the throttle valve. A spring constant of the subsidiary spring is smaller than that of the governor spring. Thus, there is provided the engine control system with the automatic choke device, which can meticulously control an air/fuel ratio from start of an engine to under-load operation of the engine in accordance with increase and decrease in temperature of the engine.

2 Claims, 4 Drawing Sheets

IN COLD STARTING

AFTER COLD STARTING

IN COLD UNDER-LOAD OPERATION

ENGINE CONTROL SYSTEM

RELATED APPLICATION DATA

The Japanese priority application No. 2007-31401 upon which the present application is based is hereby incorporated in its entirety herein by reference.

BACKGROUND OF THE INVENTION

1. Field of the Invention

The present invention mainly relates to an engine control system used in control of a rotational speed of a general-purpose engine having a small engine displacement, and particularly relates to an engine control system comprising: a governor lever which is oscillatably supported around an axis on an engine body, and connected to a throttle valve of a carburetor; a governor which increases a thrust for rotating the governor lever in a direction to close the throttle valve in accordance with an increase in an engine rotational speed; a control lever which is supported around an axis on a fixed structure, and operated to oscillate between a low-speed position and a high-speed position; a governor spring which is expandedly provided between the control lever and the governor lever, and which increases an urging force for rotating the governor lever in a direction to open the throttle valve; and an automatic choke device which is connected to a choke valve of the carburetor so as to automatically open and close the choke valve.

2. Description of the Related Art

Japanese Patent Application Laid-open No. 2006-242143 (specification of U.S. Pat. No. 7,246,794) discloses an engine control system comprising: a governor lever which is oscillatably supported around an axis on an engine body, and connected to a throttle valve of a carburetor; a governor which increases a thrust for rotating the governor lever in a direction to close the throttle valve in accordance with an increase in an engine rotational speed; and a governor spring which is expandedly provided between a fixed structure and the governor lever so as to urge the governor lever to rotate in a direction to open the throttle valve; wherein an automatic choke device is connected to a choke valve of an engine so as to automatically open and close the choke valve in accordance with increase and decrease in temperature of the engine.

In the conventional engine control system, a relatively large spring constant is imparted to the governor spring extendedly provided between the fixed structure and the governor lever in order to bring the engine into a high-speed operation state from start of the engine.

However, even if there is provided an automatic choke device, it is desirable that the engine rotational speed is set as low as possible from the start of the engine to the start of under-load operation of the engine in order to reduce the noise. From this point of view, there is a demand that a set load of the governor spring is arbitrarily switchable to a high level and a low level to make an engine rotational speed switchable to a high stage and a low stage.

In a general-purpose engine having a small engine displacement and required to be started at a low rotational speed, if an air/fuel ratio of an air/fuel mixture is set low (rich) by adjustment of the carburetor in order to obtain an excellent low-temperature starting performance of the engine, the air/fuel ratio becomes excessively low in high-temperature operation of the engine, leading to a disadvantage of an operational disorder or an increased fuel consumption.

Particularly in the system having an automatic choke device, a meticulous control is difficult to be conducted such that the air/fuel ratio is low at start of the engine, is slightly increased after the start, and is further increased at high temperatures of the engine.

SUMMARY OF THE INVENTION

The present invention has been made in view of the above circumstances, and an object thereof is to provide an engine control system having a simple structure even with an automatic choke device, wherein a set load of a governor spring is arbitrarily switchable to a high level and a low level to make an engine rotational speed switchable to a high stage and a low stage to enable start and under-load operation of the engine at low speeds, and wherein a meticulous control can be conducted such that an air/fuel ratio of an air/fuel mixture supplied to the engine is controlled from start of the engine to under-load operation state of the engine in accordance with increase and decrease in temperature of the engine to contribute to a low fuel consumption.

To achieve the above object, according to a first aspect of the present invention, there is provided an engine control system comprising: a governor lever which is oscillatably supported around an axis on an engine body, and connected to a throttle valve of a carburetor; a governor which increases a thrust for rotating the governor lever in a direction to close the throttle valve in accordance with an increase in an engine rotational speed; a control lever which is supported around an axis on a fixed structure, and operated to oscillate between a low-speed position and a high-speed position; a governor spring which is expandedly provided between the control lever and the governor lever, and which increases an urging force for rotating the governor lever in a direction to open the throttle valve; and an automatic choke device which is connected to a choke valve of the carburetor so as to automatically open and close the choke valve, wherein a play is provided between the control lever and the governor spring or between the governor lever and the governor spring, the play holding the governor spring in a free state during rotation of the control lever from the low-speed position to the high-speed position by a predetermined angle; and wherein a subsidiary spring is provided between the fixed structure and the governor lever so as to constantly urge the governor lever in a direction to open the throttle valve, a spring constant of the subsidiary spring being smaller than that of the governor spring.

With the first feature, in cold starting of the engine, the control lever is set at the low speed position and thus the throttle valve is brought into a fully-open state by the effect of the subsidiary spring alone, whereas the choke valve is held at a fully-closed state by the automatic choke device sensing a low-temperature state of the engine. Therefore, the engine is cranked, an intake negative pressure of the engine is caused to sufficiently act on a fuel nozzle of the carburetor to urge a relatively large amount of fuel injection, whereby the air/fuel ratio of the air/fuel mixture drawn into the engine is lowered, thereby smoothly starting the engine.

After the start of the engine, the thrust on the governor lever of the governor is increased with the increase in the engine rotational speed to give a moment to the governor lever in the direction to close the throttle valve, and the moment is increased so as to close the throttle valve. When the moment is balanced with a moment, which the subsidiary spring gives to the governor lever, in a direction to open the throttle valve, the closing operation of the throttle valve is stopped, whereby the throttle valve is held at a slightly-open position to bring the engine into a low-speed operation state. In this arrangement, the spring constant of the subsidiary spring is set sufficiently smaller than the governor spring, and thus even if the engine rotational speed fluctuates to some degree, change in the opening degree of the throttle valve can be suppressed to a low level, thereby stabilizing the low-speed operation of the engine.

Next, when the control lever is rotated to the high-speed position in order to drive a work machine such as a lawn mower by the engine, a load of the governor spring acting on the governor lever is maximized to direct the governor lever in the direction to open the throttle valve. An increase in the engine rotational speed with this operation increases the thrust of the governor to appropriately suppress the rotation of the governor lever in the direction to open the throttle valve, resulting in that the throttle lever is held in a half-open state.

The temperature of the engine rises with the progress of warming-up operation of the engine E, and the automatic choke device is expandedly operated to rotate the choke lever in a direction to open the choke valve. Therefore, the air/fuel ratio of the intake air/fuel mixture in the engine E is further increased, thereby further promoting the low fuel consumption.

As described above, since the start and non-load operation of the engine can be performed at low speeds, the engine can maintain a silencing performance, and a meticulous control can be conducted such that the air/fuel ratio of the air/fuel mixture supplied to the engine is controlled from the start of the engine to the under-load operation state of the engine in accordance with increase and decrease in the temperature of the engine, thereby contributing to a low fuel consumption.

The above-mentioned object, other objects, characteristics, and advantages of the present invention will become apparent from a preferred embodiment, which will be described in detail below with reference to the attached drawings.

DESCRIPTION OF THE PREFERRED EMBODIMENT

Figure 1:
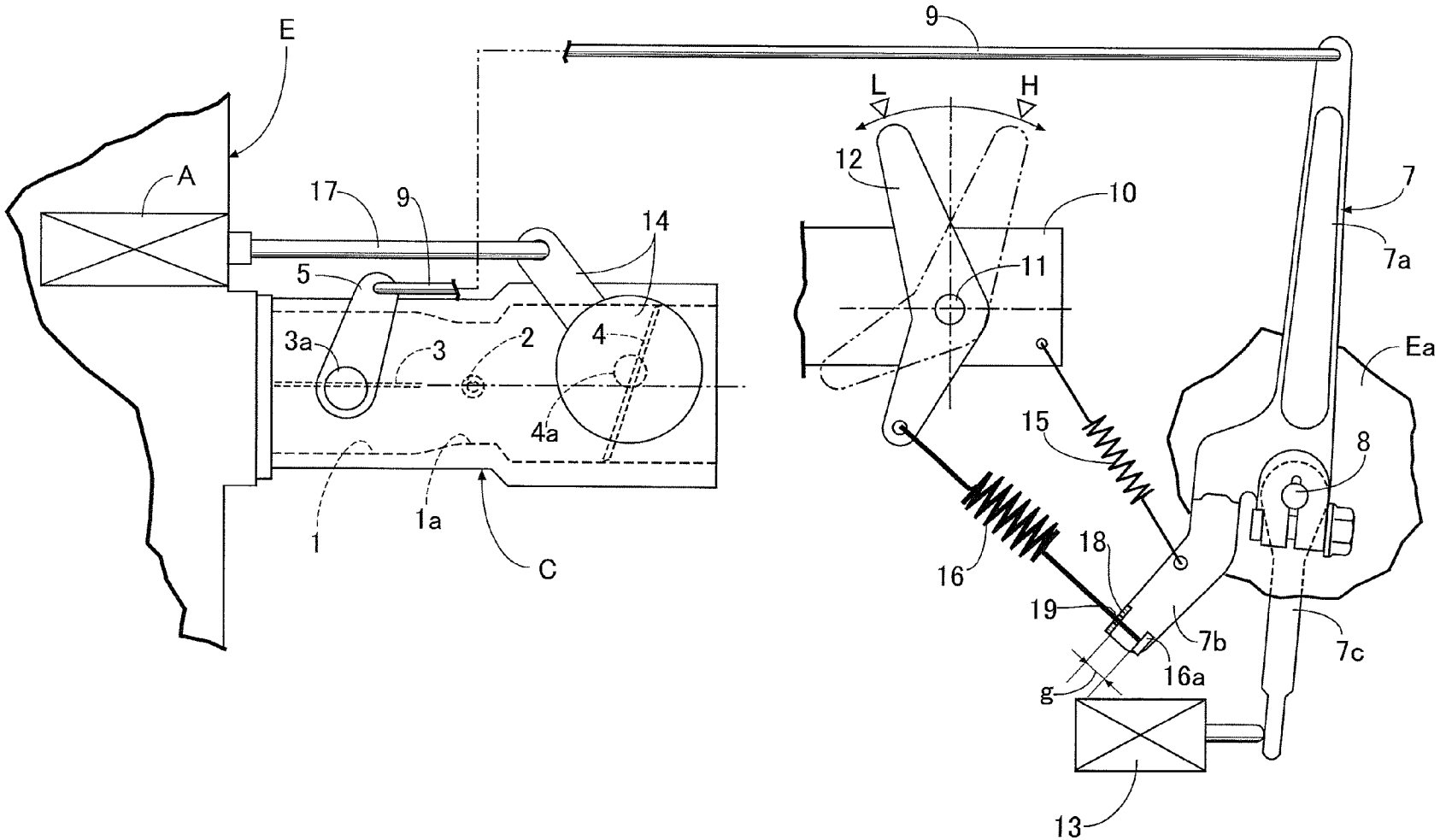
FIG. 1 is an outline view of an engine control system according to an embodiment of the present invention, showing a state in cold starting of an engine.
Figure 2:
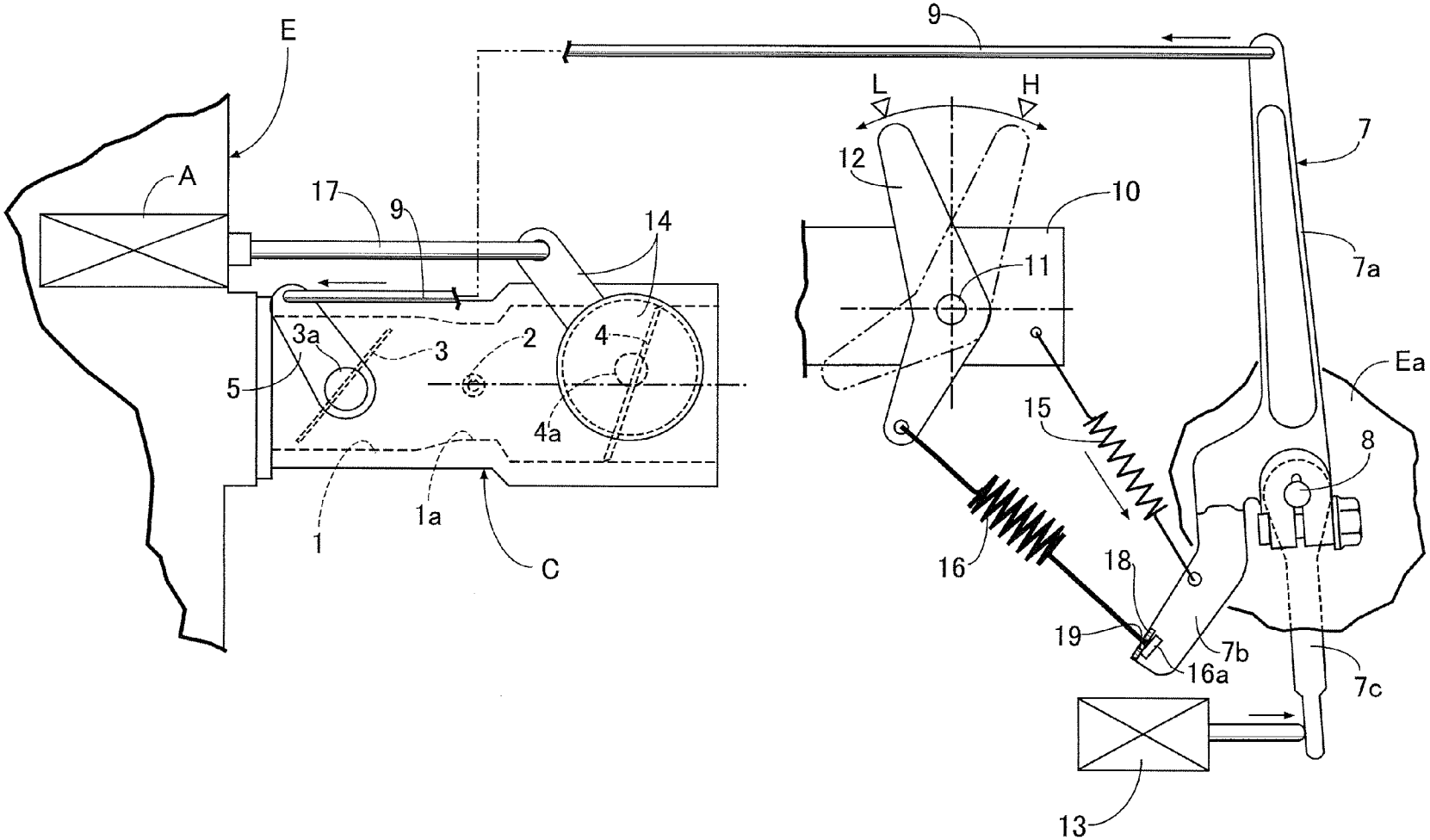
FIG. 2 is a view corresponding to FIG. 1, showing a state after the cold starting of the engine.

First, in FIG. 1, a reference character E denotes a 4-cycle general-purpose engine serving as a power source for various work machines. An carburetor C is mounted on one side face of a cylinder head of the engine E. The carburetor C has an intake path 1 leading to an intake port of the engine E. A throttle valve 3 and a choke valve 4 are provided on a downstream side and an upstream side, respectively, of a venturi portion 1*a* provided in the intake path 1 at an intermediate position therebetween. A fuel nozzle 2 is open at the venturi portion 1*a*.

A throttle lever 5 is secured to an outer end of a valve shaft 3*a* of the throttle valve 3. The throttle lever 5 is rotated to open and close the throttle valve 3.

A governor lever 7 is provided through a pivotal shaft 8 on an engine body Ea including a crank case and other components of the engine E. The governor lever 7 has three arms, that is, first, second and third arms 7*a*, 7*b* and 7*c*. The first arm 7*a* is connected through a link 9 to the throttle lever 5. When the governor lever 7 is rotated in a clockwise direction in FIG. 1, the throttle valve 3 is opened.

A bracket 10 is secured to a fixed structure (not shown) such as the engine E. A subsidiary spring 15 is extendedly provided between the bracket 10 and the second arm 7*b*. A tensile force of the subsidiary spring 15 constantly gives a moment to the governor lever 7 in a direction to open the throttle valve 3.

A control lever 12 is mounted through a pivotal shaft 11 on the bracket 10. The control lever 12 is oscillated between a low-speed position L and a high-speed position H. A governor spring 16 is connected between the control lever 12 and the second arm 7*b*. In this structure, a certain play g is provided between the governor spring 16 and the control lever 12 or between the governor spring 16 and the second arm 7*b*. The play g holds the governor spring 16 in a free state during rotation of the control lever 12 from the low-speed position L to the high-speed position H by a predetermined angle $\alpha$ (see FIG. 4).

In the illustrated embodiment, one end of the governor spring 16 is slidably inserted into a through hole 19 bored in a spring connection wall 18 of the second arm 7*b* in the governor lever 7. The play g is provided between a stopper 16*a* formed at one end of the second arm 7*b* and the spring connection wall 18 facing the stopper 16*a*.

When the control lever 12 or the governor lever 7 is rotated so as to eliminate the play g, that is, to bring the stopper 16*a* into contact with the connection wall 18, a tensile force generated by the governor spring 16 gives a moment to the governor lever 7 in the direction to open the throttle valve 3.

Figure 4:
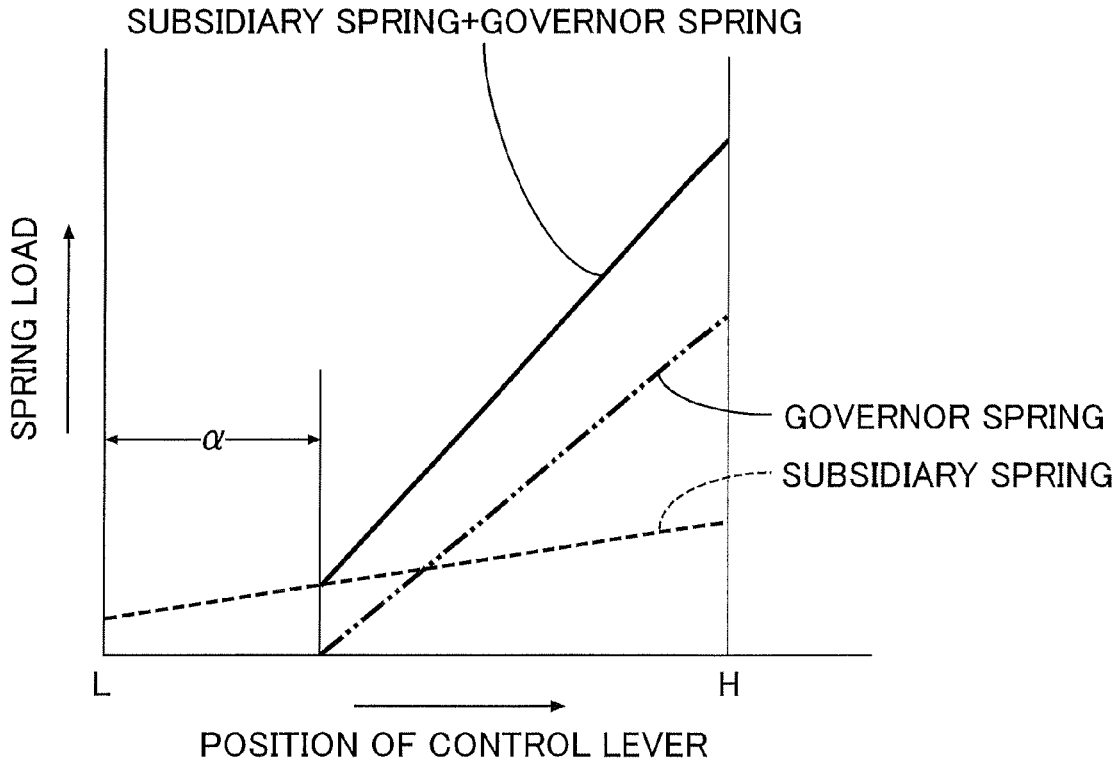
FIG. 4 is a spring characteristic diagram in the engine control system.

Specifically, as shown in FIG. 4, a spring constant of the subsidiary spring 15 is set sufficiently smaller than that of the governor spring 16. Therefore, while the control lever 12 is rotated from the low-speed position L by a predetermined angle $\alpha$, a load of the subsidiary spring 15 on the governor lever 7 is changed only slightly. However, when the control lever 12 is rotated by the predetermined angle $\alpha$ or more, a load of the governor spring 16 is added to the load of the subsidiary spring 15, whereby the load on the governor lever 7 is steeply increased. In this arrangement, the predetermined angle $\alpha$ is preferably set closer to the low-speed position L with respect to an intermediate position between the low-speed position L and the high-speed position H.

A known centrifugal governor 13 is connected to the third arm 7*c*, and driven by a rotating shaft of the engine E. The centrifugal governor 13 generates a thrust which increases in accordance with an increase in the engine rotational speed. The thrust gives a moment to the governor lever 7 in the direction to close the throttle valve 3.

A valve shaft 4*a* of the choke valve 4 is arranged while being offset from the center line of the intake path 1 to one side. In the fully-open state, the choke valve 4 is inclined with respect to the center axis of the intake path 1 such that a larger-radius side of the choke valve 4 situates downstream in the intake path 1 as compared with a smaller-radius side thereof. A choke lever 14 is mounted on an outer end of the valve shaft 4*a* projecting out of the carburetor C. The choke lever 14 has a hollow cylindrical shape to which the valve shaft 4*a* is relatively rotatable fitted. The choke lever 14 is connected to the valve shaft 4*a* through a known relief spring (not shown) inside the choke lever 14. The fully-open and fully-closed positions of the choke valve 4 are defined by abutment with stoppers (not shown) provided on an outer wall of the carburetor C.

When the choke valve 4 is fully closed or slightly opened, if the intake negative pressure of the engine E exceeds a predetermined value, the choke valve 4 is opened until a difference between a rotational moment due to the intake negative pressure acting on the larger-radius side of the choke valve 4 and a rotational moment due to the intake negative pressure acting on the smaller-radius side of the choke valve 4 is balanced with a rotational moment provided by the relief spring.

An automatic choke device A is connected through a link 17 to the choke lever 14. The automatic choke device A automatically controls the opening degree of the choke valve 4 in accordance with change in the temperature of the engine E. The automatic choke device A is configured to be a simple wax type, for example.

Next, the operation of this embodiment will be described.

In the cold starting of the engine E, as shown in FIG. 1, the governor spring 16 is first brought into an inoperative state by setting the control lever 12 at the low-speed position L. Even at the low-speed position L of the control lever 12, the subsidiary spring 15 constantly urges the throttle valve 3 in the opening direction through the governor lever 7, and thus the throttle valve 3 is in the fully-open state. On the other hand, the choke valve 4 is held by the automatic choke device A sensing the low-temperature state of the engine to perform the contracting operation.

Then, in order to start the engine E, a recoil starter, for example, is operated to crank the engine E, a large negative pressure is generated in the intake path 1 at a position downstream of the choke valve 4 in the carburetor C. This large negative pressure sufficiently acts on the fuel nozzle 2 which is open in the venturi portion 1*a*, thereby injecting a relatively large amount of fuel to lower the air/fuel ratio of the mixture taken into the engine E. That is, the mixture is enriched to smoothly start the engine E.

After the start of the engine E, the thrust of the centrifugal governor 13 acting on the governor lever 7 is increased with the increase in the engine rotational speed to give a moment to the governor lever 7 in the direction to close the throttle valve 3, and the moment is increased so as to close the throttle valve 3. When the moment is balanced with the moment, which the subsidiary spring 15 gives to the governor lever 7, in the direction to open the throttle valve 3, the closing operation of the throttle valve 3 is stopped. Therefore, the throttle valve 3 is held at the slightly-open position to bring the engine E into the low-speed operation state.

Since the spring constant of the subsidiary spring 15 is set sufficiently small as described above, even if the rotational speed of the engine E fluctuates to some degree, the change in the opening degree of the throttle valve 3 can be suppressed to a low level, thereby stabilizing the low-speed operation of the engine.

Moreover, after the start of the engine E, when the intake negative pressure generated in the downstream in the intake path 1 exceeds the predetermined value, the choke valve 4 is opened until the difference between the rotational moment due to the intake negative pressure acting on the larger-radius side of the choke valve 4 and the rotational moment due to the intake negative pressure acting on the smaller-radius side of the choke valve 4 is balanced with the rotational moment provided by the relief spring inside the choke lever 14, as described above. Therefore, an excessive increase in the negative pressure on the fuel nozzle 2 in the intake path 1 is prevented, an excessive fuel injection from the fuel nozzle 2 is suppressed, and the air/fuel ratio of the air/fuel mixture taken into the engine E is increased, that is, the air/fuel mixture is prevented from being excessively enriched, thereby promoting the low fuel consumption.

Figure 3:
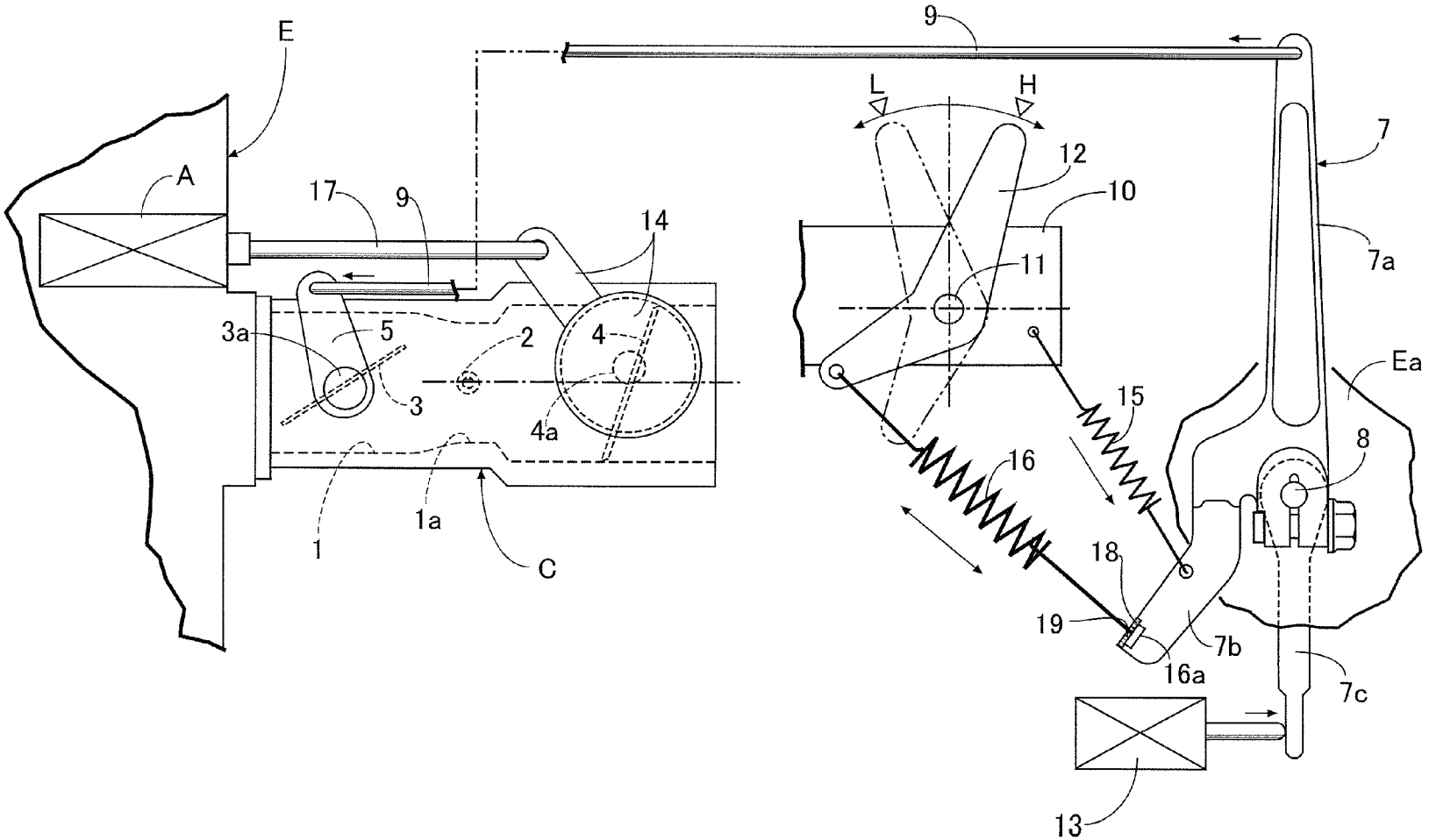
FIG. 3 is a view corresponding to FIG. 1, showing a state in a cold under-load operation of the engine.

Next, in order to drive a work machine such as a lawn mower by the engine E, when the control lever 12 is rotated to the high-speed position H, the play g at the end of the governor spring 16 is eliminated from the point the control lever 12 is rotated by the predetermined angle $\alpha$, and the operation of the governor spring 16 is started. When the control lever 12 reaches the high-speed position H, the tensile load of the governor spring 16 acting on the governor lever 7 is maximized to direct the governor lever 7 in the direction to open the throttle valve 3. The increase in the engine rotational speed with this operation increases the thrust of the governor 13 to appropriately suppress the rotation of the governor lever 7 in the direction to open the throttle valve 3, resulting in that the throttle lever 5 is held in the half-open state as shown in FIG. 3.

In the work machine such as a lawn mower to which the present invention is applied, since the predetermined angle $\alpha$ is preferably set closer to the low-speed position L with respect to an intermediate position between the low-speed position L and the high-speed position H, if the control lever 12 is on the low-speed position L side, the centrifugal governor 13 operates so that the actual engine rotational speed is suppressed from increasing over the engine rotational speed corresponding to the predetermined angle $\alpha$. Therefore, there is expected an effect of suppressing deterioration of the low fuel consumption during operation at the low-speed position L.

The temperature of the engine E rises with the progress of warming-up operation of the engine E, and the automatic choke device A is expandedly operated to rotate the choke lever 14 in the direction to open the choke valve 3. Therefore, the air/fuel ratio of the intake air/fuel mixture in the engine E is further increased, thereby further promoting the low fuel consumption.

Thereafter when the operation of the engine E is stopped, as long as the high-temperature state of the engine E continues, the automatic choke device A continues to expandedly operate, thereby maintaining the open state of the choke valve 4. Therefore, when the engine E in the high-temperature state is re-started, the open state of the choke valve 4 is secured to prevent the air/fuel mixture from being excessively enriched, thereby providing an excellent re-starting performance.

As described above, since the start and non-load operation of the engine E can be performed at low speeds, the engine E can maintain the silencing performance, and the meticulous control can be conducted such that the air/fuel ratio of the air/fuel mixture supplied to the engine E is controlled from the start of the engine to the under-load operation state of the engine E in accordance with increase and decrease in the temperature of the engine, thereby contributing to the low fuel consumption.

The present invention is not limited to the above-described embodiment, and various changes in design can be made without departing from the subject matter of the present invention.

What is claimed is:

1. An engine control system comprising:

a governor lever which is oscillatably supported around an axis on an engine body, and integrally has a first arm, a second arm and a third arm, the first arm being connected to a throttle valve of a carburetor through a link;

a governor which operationally engages the third arm of the governor lever and increases a thrust for rotating the governor lever in a direction to close the throttle valve in accordance with an increase in an engine rotational speed;

a control lever which is supported around an axis on a fixed structure, and operated to oscillate between a low-speed position and a high-speed position;

a governor spring which has one end connected to the second arm of the governor lever and is expandedly provided between the control lever and the governor lever, and which increases an urging force for rotating the governor lever in a direction to open the throttle valve; and an automatic choke device which is connected to a choke valve of the carburetor so as to automatically open and close the choke valve, wherein a play is provided between the control lever and the governor spring or between the governor lever and the governor spring, the play holding the governor spring in a free state during rotation of the control lever from the low-speed position to the high-speed position within a predetermined angle;

wherein a subsidiary spring is directly affixed to the fixed structure and at one end thereof to the second arm of the governor lever and constantly urges the governor lever in a direction to open the throttle valve, and wherein a spring constant of the subsidiary spring is less than a spring constant of the governor spring, wherein during rotation of the control lever by an amount equal to or larger than the predetermined angle, a load of the governor spring is added to a load of the subsidiary spring, and wherein a rotating force acting on the governor lever is increased, wherein said amount of rotation of the control lever is set as corresponding to a position closer to the low speed position with respect to an intermediate position between the low speed position and the high speed position, wherein the subsidiary spring is connected to the second arm of the governor lever at a position closer to the axis of the governor lever than the governor spring, and wherein when the control lever is at the high speed position, the throttle valve is held in a half-open state by the governor spring and the subsidiary spring, which act on the governor lever in the direction to open the throttle valve, and by the governor which acts on the governor lever in the direction to close the throttle valve.

2. The engine control system according to claim 1, wherein in a cold under-load operation of the engine, when the control lever is at the high speed position, the choke valve is held in a closed state.

* * * * *